US005244511A

United States Patent [19]

Komatsubara et al.

[11] Patent Number: 5,244,511

[45] Date of Patent: Sep. 14, 1993

[54] METHOD OF MANUFACTURING AN ORIENTED SILICON STEEL SHEET HAVING IMPROVED MAGNETIC FLUX DENSITY

[75] Inventors: Michiro Komatsubara; Mitsumasa Kurosawa; Yasuyuki Hayakawa; Takahiro Kan; Toshio Sadayori, all of Chiba, Japan

[73] Assignee: Kawasaki Steel Corporation, Japan

[21] Appl. No.: 6,671

[22] Filed: Jan. 19, 1993

Related U.S. Application Data

[63] Continuation of Ser. No. 735,032, Jul. 24, 1991, abandoned.

[30] Foreign Application Priority Data

Jul. 27, 1990 [JP] Japan ..... 2-197822

[51] Int. Cl.[5] ..... C21D 8/12; C22C 38/60

[52] U.S. Cl. ..... 148/111; 148/112

[58] Field of Search ..... 148/111, 112, 113, 102, 148/12.3

[56] References Cited

U.S. PATENT DOCUMENTS 3,940,299 2/1976 Goto et al. ..... 148/111

4,824,493 4/1989 Yoshitomi et al. ..... 148/112

FOREIGN PATENT DOCUMENTS 1073832 4/1986 Japan ..... 148/111

*Primary Examiner*—R. Dean

*Assistant Examiner*—Sikyin Ip

*Attorney, Agent, or Firm*—Austin R. Miller

[57] ABSTRACT

A method of manufacturing an oriented silicon steel sheet which achieves a high magnetic flux density while reducing the core loss. A silicon steel sheet containing Al and Sb as inhibitor components is cold-rolled once or a plurality of times. During cooling for annealing before final cold rolling, a small strain is created on the sheet and the temperature is within a certain range. Carbide precipitation is suitably controlled to precipitate carbides comparatively coarsely in grains.

7 Claims, 2 Drawing Sheets

1000 Å

1000 Å

METHOD OF MANUFACTURING AN ORIENTED SILICON STEEL SHEET HAVING IMPROVED MAGNETIC FLUX DENSITY

This application is a continuation of U.S. patent application Ser. No. 07/735,032, filed Jul. 24, 1991, now abandoned.

BACKGROUND OF THE INVENTION

This invention relates to a method of manufacturing an oriented silicon steel sheet having improved magnetic characteristics and, more particularly, to an improved method of preventing reduction of magnetic flux density notwithstanding reduction of thickness of the silicon steel sheet.

High magnetic flux density and a small core loss are magnetic characteristics required in grain-oriented silicon steel sheets. Recent progress in manufacture techniques has made it possible to make, for example, a silicon steel sheet having a magnetic flux density $B_8$ (the value at a magnetizing force of 800 A/m) of 1.92 T for a sheet having a thickness of 0.23 mm. It is also possible to manufacture, on an industrial scale, an improved silicon steel sheet product having a core loss characteristic $W_{17/50}$ (value under a fully magnetized condition: 1.7 T at 50 Hz}of 0.90 w/kg.

Silicon steel sheets having such improved magnetic characteristics have crystalline structures in which the <001> directions parallel to the axis of easy magnetization are uniformly aligned in the direction of rolling of the steel sheet. Such a texture is formed during finishing annealing by a phenomenon called secondary recrystallization in which crystal grains having a (110) [001] direction called the Goss direction are grown with priority into giant grains. Fundamental requirements for effectively growing secondary recrystallized grains include the existence of an inhibitor for limiting the growth of crystal grains having undesirable directions other than the (110) [001]direction in the secondary recrystallization process and the formation of a primary recrystallized crystalline structure suitable for effectively developing secondary recrystallized grains in the (110) [001] direction.

A fine precipitate of MnS, MnSe, AlN or the like is ordinarily utilized as the inhibitor. The effect of the inhibitor has been enhanced by adding a grain boundary segregation type component such as Sb or Sn to the inhibitor. Conventionally, methods in which MnS or MnSe is used as a main inhibitor are advantageous in reducing the core loss of certain sheets because they assist in reducing the sizes of the secondary recrystallized grains. However, methods based on laser irradiation or plasma jetting have recently been provided to artificially form pseudo grain boundaries so that the magnetic domains are fractionated and the core loss is reduced. For this reason the advantage of reducing the sizes of the secondary recrystallized grains has been lost. Further, the concept of increasing the magnetic flux density of the steel sheet has become advantageous.

A method of manufacturing an oriented silicon steel sheet having a large magnetic flux density is disclosed in Japanese patent Publication 46-23820. According to this method, the desired steel sheet can be manufactured by (a) introducing Al into the steel as an inhibitor component, (b) quenching to obtain cooling before final cold rolling to precipitate AlN, and (c) increasing the rolling reduction of the final cold rolling from a lower reduction to a higher reduction, like from 65 to 95%.

The method of the Japanese Publication, however, entails a problem in that the magnetic flux is abruptly reduced along with the reduction of thickness of the product sheet. It is very difficult or impossible to manufacture by the method of the Japanese Publication the type of silicon steel sheet presently in demand, e.g., a thin product having a thickness of 0.25 mm or less and having a $B_8$ value of 1.94 T or higher.

In Japanese patent Publication 46-23820, immersing a steel sheet in hot water at 100° C. after annealing to quench the sheet is disclosed, but there is no consideration or mention of any phase of any carbides after quenching. Ordinarily, in the case of slow cooling from 600° C. or lower, carbides are precipitated from grain boundaries at a higher temperature and are precipitated in crystal grains at a lower temperature. Carbides precipitated are finer and have a higher density if precipitation is started at a reduced temperature. Accordingly, with respect to the first embodiment of Japanese patent Publication 46-23820 in which the time for cooling from 1,000 to 750° C. is about 10 seconds and the time for cooling from 750 to 100° C. is about 25 seconds, it is not unreasonable to conclude that very fine carbides having particle sizes of several tens of angstroms are precipitated or that the extent of carbide precipitation is limited and that the carbon is simply supersaturated in the steel.

Japanese Patent Publication 56-3892 discloses a technique for controlling carbides in other steels during cooling after annealing. In this method, with respect to two-stage cold rolling, the steel is cooled at a cooling speed of 150° C./min or higher from 600 to 300° C. during cooling after annealing followed by final cold rolling so that the amount of solid solution carbon after cooling is increased. This method is intended to improve the magnetic characteristics of the steel by increasing the amount of solid solution carbon in the steel and by optimizing the aging effect between cold rolling paths. Such an effect of solid solution carbon is well known in the case of ordinary cold-rolled steel sheets. If the amount of solid solution C or solid solution N before cold rolling is increased, the (110) intensity in the recrystallized structure formed by recrystallization annealing after cold rolling is increased. In the case of oriented silicon steel sheets, the (110) grains become nuclei for secondary recrystallization, so that the number of secondary recrystallized grains is increased, the secondary-recrystallized grains are finer, and improved magnetic characteristics can be achieved. This method, however, does not enable the magnetic flux density of a thin oriented silicon steel sheet to be increased.

As a technique for controlling the form of C in steel to increase the (110) intensity of the steel, a method of precipitating many fine carbide grains during cooling after intermediate annealing is disclosed in Japanese Patent Laid-Open Publication 58-157917. In this method, quenching of the steel to 300° C. is effected after intermediate annealing and slow cooling is applied for 8 to 30 seconds through a temperature range of 300 to 150° C., thereby precipitating fine carbides. The (110) intensity of the steel after recrystallization is thereby increased so that the magnetic characteristics of the steel are improved. However, the magnetic characteristics achieved by these methods are at most 1.94 T with respect to B and 1.92 T with respect to $B_8$ when the sheet thickness is 0.3 mm, which value is not high enough to be satisfactory.

Japanese Patent Laid-Open Publication 61-149432 discloses a technique based on setting the cooling speed of steel to 10° C./s or higher at the time of cooling after intermediate annealing, creating a work strain of 1 to 30 % during cooling from 1,000 to 400° C., and performing finishing rolling at a temperature in the range of 100° C. to 400° C. According to this method, a work strain of 1 to 30 % is created at a temperature in the range of 1,000 to 400° C. in which the C diffusion speed is very high to provide high-density dislocations, so that C is finely precipitated at the dislocations and the (110) intensity is increased. To finely precipitate C in dislocations at a high density, the working is performed by rolling, and a high cooling speed of 10° C./s or higher is set for the precipitation step. The core loss can be reduced to a certain extent by this method but the magnetic flux density achieved by this method is only 1.91 T with respect to $B_{10}$ (1.89 T with respect to $B_8$), which is low.

OBJECTS OF THE INVENTION

It is an object of the present invention to provide a method of manufacturing an oriented silicon steel sheet which enables maintenance of high magnetic flux density notwithstanding reduction of steel sheet thickness. Another object is to achieve a high magnetic flux density with desired stability while reducing the core loss of steel sheet.

SUMMARY OF THE INVENTION

It has been discovered that, in an Al-containing oriented silicon steel sheet in which Sb is also present, the precipitation of carbides is greatly changed during cooling for annealing before final cold rolling, and that such precipitation is effective to increase the ultimate (111) intensity of the recrystallized structure after final cold rolling of sheet rather than the (110) intensity, and that carbides precipitated in crystal grains at a high temperature in the range of about 200 to 500° C. under strain during cooling for annealing before final cold rolling, which are conventionally regarded as undesirable, surprisingly have the effect of increasing the {111}<112> intensity while reducing the {111}<uvw> intensity, more particularly the {111}<110> intensity, so that a very high magnetic flux density can be obtained with stability irrespective of the thickness of the final product.

That is, according to the present invention, there is provided a method of manufacturing an oriented silicon steel sheet having greatly improved magnetic characteristics in which a hot-rolled steel sheet of a silicon steel containing about 0.01 to 0.15 % by weight of acid-soluble Al and about 0.005 to 0.04% by weight of Sb as inhibitor components is cold-rolled once or a plurality of times until its thickness is reduced to the desired predetermined final thickness. The method further comprises softening-annealing the steel sheet before final cold rolling, successively quenching the steel sheet at a cooling speed of about 15 to 500° C./s to a temperature of about 500° C. or lower; creating upon the sheet a small strain ranging from about 0.005 to 3.0% in a temperature range from about the temperature reached by quenching to about 200° C.; controlling carbide precipitation by cooling the steel sheet during this straining or after a period of time of about 60 to 180 seconds in which the steel sheet is maintained within the same temperature range after straining, or by slowly cooling the steel sheet at a cooling speed cf about 2° C./s or lower; and thereafter performing final cold rolling with a rolling reduction of about 80 to 95%. This can be done in conjunction with additional steps of effecting annealing for primary recrystallization as well as decarburization; applying an annealing separation agent; and effecting secondary recrystallization annealing and purification-annealing.

Other features and variations of the present invention will become apparent from the following detailed description of the invention.

DETAILED DESCRIPTION OF THE INVENTION

Figure 1:
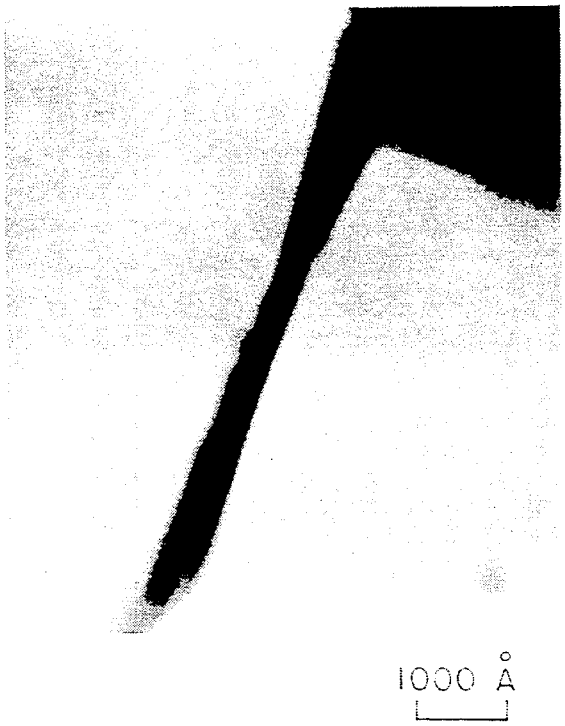
FIGS. 1 to 4 are transmission-electron-microscopic photographs of examples of structures of steel sheets after annealing followed by final cold rolling, showing forms of carbides at a depth of one-tenth of the sheet thickness measured from the surfaces of the steel sheets.

First, the results of experiments on which the present invention is based will be described below.

Al-containing oriented silicon steel sheets to which Sb, Sn, Ge, Ni and Cu (well-known as additive components) were separately added were provided. These sheets were rolled different times to manufacture products; one group of these steel sheets was cold-rolled only one time to obtain products having a thickness of 0.30 mm, and another group was cold-rolled twice to obtain products having a thickness of 0.23 mm.

The rolling reduction of the final cold rolling was set at 88%, and annealing immediately before final cold rolling was performed at 1,150° C. for 90 seconds with respect to the steel sheets cold-rolled one time, and at 1,100° C. for 90 seconds with respect to the steel sheets cold-rolled twice. Cooling was performed by immersing each steel sheet in hot water at 80° C.

The results of this experiment are as shown in Table 1. Each of the 0.30 mm thick steel sheets had a high magnetic flux density while each of the 0.23 mm thick steel sheets had a reduced magnetic flux density. The reduced sheet thickness had seriously reduced the flux density in every case.

TABLE 1

| Sample No. | | | 1 | 2 | 3 | 4 | 5 | 6 |
|---|---|---|---|---|---|---|---|---|
| Additive | Constituent name | | No additive | Ni | Cu | Sb | Sn | Ge |
| | Amount of additive (%) | | — | 0.08 | 0.10 | 0.03 | 0.05 | 0.02 |
| Magnetic flux density $B_8$ (T) | Product thickness | 0.30 mm | 1.924 | 1.925 | 1.923 | 1.936 | 1.903 | 1.914 |
| | | 0.23 mm | 1.885 | 1.885 | 1.887 | 1.894 | 1.882 | 1.884 |

By examining the results of Table 1 in detail, it is evident that sample 4 in which Sb was present had a slightly better magnetic flux density than the other five samples.

To examine the cause of this effect we examined the textures of samples of decarburized primary recrystallized sheets with respect to the samples having a product thickness of 0.23 mm, and examined the forms of precipitated carbides in the steel of each sample after intermediate annealing. The results of these examinations are shown in Table 2.

TABLE 2

| Sample No. | 1 | 2 | 3 | 4 | 5 | 6 |
|---|---|---|---|---|---|---|
| Additive constituent | No additive | Ni | Cu | Sb | Sn | Ge |
| (110) Intensity | 0.15 | 0.16 | 0.18 | 0.12 | 0.22 | 0.25 |
| (222) Intensity | 7.3 | 7.5 | 7.0 | 8.8 | 6.4 | 6.8 |
| Form of carbide precipitation in intermediate annealed sheet | Mostly in solid solution, partially precipitated finely | Mostly in solid solution, partially precipitated finely | | Precipitated slightly coarsely in grains | Precipitated finely and at a high density in grains | |
| Precipitated size | About 80Å | About 80Å | | About 200Å | About 50Å | |

As can be understood from Table 2, no increase in the (110) intensity is attributed to the presence of Sb as observed in sample 4 containing Sb, unlike the effect that might have been expected in view of conventional technical concepts, but the (111) intensity (equivalent to (222)) was remarkably increased in the sample containing Sb. Further, different forms of carbides exist after annealing followed by final cold rolling and, as a result of the addition of Sb, the fine high-density precipitated state or the C solid solution state was changed so that carbides were precipitated in the form of slightly coarse grains (Table 2, column 4) having particle sizes much greater than the others in the Table.

In contrast, in the case of addition of Sn or Ge, carbides were finely precipitated at a high density, and the (110) intensity of the primary recrystallized structure was remarkably improved.

The cause of this special effect achieved by the presence of Sb is not clear. However, it is speculated that the tendency of Sb to strongly segregate at grain boundaries or surfaces is related to the phenomenon leading to the occurrence of specially precipitated forms of carbides.

With a view to positive utilization of such variations of the forms of carbides before final cold rolling, and to create new effects by varying cooling conditions, further experiments were conducted. Tests were conducted on the same Al-containing oriented silicon steel sheets as those used in the above-described experiments to which only Sb was added, and also on the same Al-containing silicon steel sheets which had no added component. The tested steels were processed by ordinary two-stage rolling to product products each having a thickness of 0.23 mm. In this experiment, the rolling reduction of final cold rolling was set at 85 %, annealing before the final cold rolling (intermediate annealing) was effected at 1,100° C. for 90 seconds, and cooling was effected under the following different cooling conditions:

(a) Condition (a) wherein the steel sheet was quenched at a rate of 50° C./s until 500° C. was reached, and thereafter cooled at a very low cooling speed of 0.5 to 2° C/s by being inserted in a heat maintaining furnace, (b) Condition (b) wherein the steel sheet was quenched at a rate of 50° C./s until 350° C. was reached, and thereafter cooled at a very low cooling speed of 0.5 to 2° C/s by insertion into a heat maintaining furnace, (c) Condition (c}wherein the steel sheet was quenched at a rate of 50° C/s until 350° C. was reached, successively skin-pass-rolled to reduce by 0.5 %, and cooled at a very low cooling speed of 0.5 to 2° C./s by insertion into a heat maintaining furnace, (d) Condition (d) wherein the steel sheet was quenched at a rate of 50° C./s until 150° C. was reached, and thereafter cooled at a very low cooling speed of 0.5 to 2° C./s by insertion into a heat maintaining furnace, (e) Condition (e) wherein the steel sheet was immersed in hot water at 80° C. so that the average cooling speed was 62° C./s, was maintained at 80° C. after being cooled to this temperature, and was thereafter cooled naturally.

The products thereby manufactured were examined with respect to magnetic flux density, (110}intensity and (222) intensity of the decarburized primary recrystallized sheets and the precipitated forms of carbides in the intermediate annealed sheets. The results are shown in Table 3.

TABLE 3

| | | Conditions of cooling for intermediate annealing | | | | |
|---|---|---|---|---|---|---|
| Material | Item | a | b | c | d | e |
| Sheets containing no additive | $B_8$ (T) | 1.707 | 1.845 | 1.867 | 1.880 | 1.885 |
| | (110) Intensity | 0.08 | 0.10 | 0.14 | 0.11 | 0.16 |
| | (222) Intensity | 8.4 | 8.6 | 7.3 | 7.8 | 7.6 |
| | Form of carbide precipitation after intermediate annealing | Precipitated mainly at grain boundaries | Carbide precipitates of about 1,000Å in grains | Fine high-density carbide precipitates of about 100Å | Fine high-density carbide precipitates of about 80Å in grains | Fine high-density carbide precipitates of about 50Å in grains |
| Sheets containing Sb | $B_8$ (T) | 1.846 | 1.912 | 1.941 | 1.910 | 1.894 |
| | (110) Intensity | 0.07 | 0.09 | 0.12 | 0.13 | 0.10 |
| | (222) Intensity | 9.1 | 8.8 | 8.4 | 8.7 | 8.5 |
| | Form of carbide precipitation after intermediate annealing | Coarsely precipitated mainly in grains | Carbide precipitates of about 2,000Å in grains | Carbide precipitates of about 300Å in grains | Fine carbide precipitates of about 200Å in grains | Mainly in solid solution in steel, partially precipitated in grains |

Figure 2:
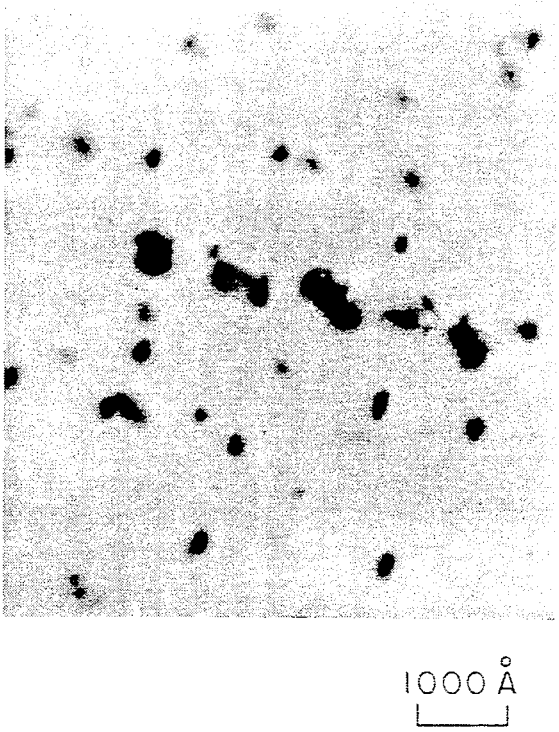
Figure 3:
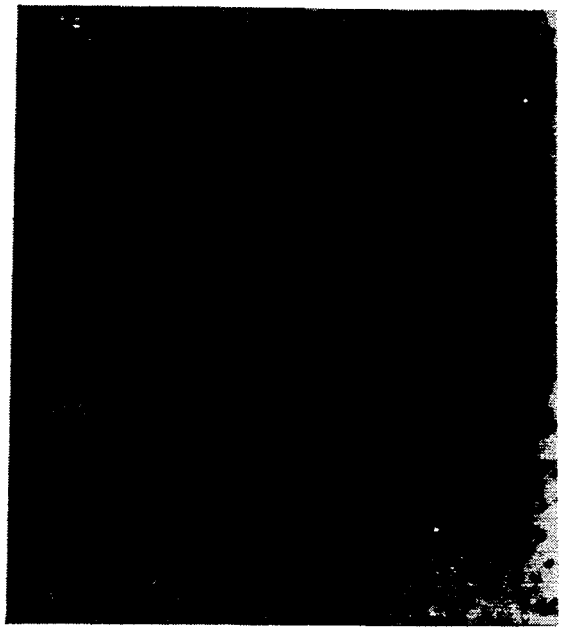
Figure 4:
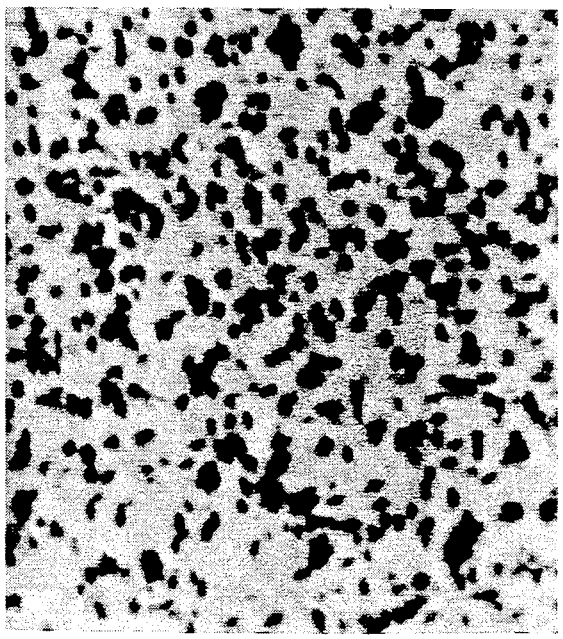

FIGS. 1 to 4 are transmission-electron-microscopic photographs of the structures of steel sheets after annealing followed by final cold rolling, showing forms of carbides at a depth of 1/10 of the sheet thickness from the surfaces of the steel sheets. FIG. 1 shows a sample to which Sb was added and which was cooled under Condition (e), FIG. 2 shows a sample (Table 3, column c, bottom) to which Sb was added and which was cooled under Condition (c), FIG. 3 shows a sample which had no additive component and which was cooled under Condition (e}(Table 3, column 3, top), and FIG. 4 shows a sample which had no additive component and which was cooled under Condition (c) (Table 3, column c, top).

As is shown in Table 3, the magnetic flux density ($B_8$)(T) of the sample to which Sb was added (bottom half of Table 3) and which was manufactured under the intermediate annealing cooling condition (c) (Table 3, column c) was particularly high. In this sample, carbide precipitates having a size ranging from 300 to 500 Å and sparsely precipitated were observed after the intermediate annealing, and are shown in FIG. 2, as heretofore noted. In contrast, in the sample which had no additive component and which was manufactured under the same cooling condition (c) (Table 3, column c, top), fine carbide precipitates having a size of about 100 Å were undesirably precipitated at a high density, as shown in FIG. 4.

With respect to the steel sheets which had no additive component, in the case of creating a work strain by skin-pass-rolling in accordance with the condition (c), carbide precipitation sites were increased during cooling so that carbides were finely precipitated at a high density, as is apparent from comparison with processing under the condition (b). In contrast, with respect to the steel sheets to which Sb was added, precipitation sites were not increased and slightly coarse precipitates were observed. According to our study after these experiments, such sparse precipitation of carbides having a size ranging from 300 to 500 Å increases the (111) intensity of the structure primarily recrystallized by decarburization annealing after final cold rolling and reduces the {111}<uvw>, in particular the {111}<110> intensity while increasing the {111}<112> intensity. The (111}110grains limit the growth of the (110) [001]secondary grains which contribute to the increase in the magnetic flux density, while the {111}<112> grains promote the growth of (110) [001] secondary grains. It is thought that addition of Sb in the particular process provides this effect and enables formation of a product having a substantially high magnetic flux density as in the case of Condition (c) as shown in the top portion of Table 3.

It is thought that this effect of Sb in steel relates to segregation of Sb, that Sb is segregated at base points in crystal grains such as to form carbide precipitation sites, and that this segregation results from the limitation of precipitation carbides during cooling.

This action of Sb is particularly effective in a temperature range of about 200 to 500° C.; the amount of strain to be applied may be very small, e.g., about 0.005 to 3%. It has also been found that the aging effect at the time of final cold rolling can also be improved according to this invention because the amount of solid solution carbon is increased by the carbide precipitation limiting effect of Sb.

It is known that a small strain of 0.5 % created by skin-pass-rolling is concentrated at a surface-layer portion of the steel sheet. In this work as well, the form of precipitated carbides wa changed according to the change in the amount of strain in the thickness direction of the sheet, and the density of precipitated carbides was reduced toward the center of the sheet in the thickness direction.

The fact that the form of precipitated carbides was changed in the sheet thickness direction is regarded as a reason for the success of this work. To positively utilize this effect, a similar experiment was also conducted by creating a strain of 0.5 % by bending with a leveler, and suitable effects were thereby obtained.

A carbide precipitation processing method is disclosed in Japanese Patent Laid-Open 61-149432. In this method, high-density dislocations uniform in the direction of sheet thickness are provided by rolling at a high temperature of 1,000 to 400° C., and the speed of cooling in a step of precipitating carbon is high, such as 10° C./s. This method is intended to precipitate finely divided carbides and to increase the (110) [001] intensity of the texture of the product.

Japanese Patent Laid-Open 58-15797 also discloses a technique for precipitating carbides of a size of 100 to 500 Å. In this case, however, the precipitation temperature range is a range of low temperatures, i.e., 300 to 150° C., and the effect of Sb is not effectively utilized, and there is no disclosure or suggestion of our special ideas relating to the precipitation processing which constitutes a feature of the present invention, including that of creating a strain during precipitation. This technique is therefore sharply different from the present invention with respect to the carbide precipitation density and requires high-density precipitation for increasing the (110) [001]intensity as in the case of the method disclosed in Japanese Patent Laid-Open 61-149432.

In contrast, in accordance with the present invention, it is important to precipitate carbides sparsely to reduce the {111}<uvw> intensity, in particular the {111}<110> intensity of the primary recrystallized structure while increasing its {111}<112> intensity.

It is important to define the ranges of chemical components of the composition of the oriented silicon steel sheet in accordance with the present invention. Preferable ranges of the components will be described below.

C is necessary for improving the hot-rolled structure of the steel. However, if the C content is excessive, it is difficult to decarburize the steel. It is therefore preferable to limit the carbon content to a range of about 0.035 to 0.090% by weight.

If the Si content is below a lower limit the desired core loss characteristic cannot be obtained. If the Si content is excessive it is difficult to perform cold rolling. It is preferable to provide an Si content in the range of about 2.5 to 4.5 % by weight.

Mn can be utilized as an inhibitor component. In case of an excessively large amount of Mn, Mn compound in the steel cannot be dissolved during slab-reheating process, and it is accordingly preferable to provide an Mn content in the range of about 0.05 to 0.15% by weight.

S or Se is effective when combined with Mn to form MnS or MnSe which acts as an inhibitor. The range of S or Se content for finely precipitating MnS or MnSe is preferably about 0.01 to 0.04 % by weight in either case of whether used alone or together.

It is specifically necessary for the steel sheet of the present invention to contain acid-soluble Al or N as inhibitor components for the purpose of achieving a high magnetic flux density, and addition of certain amounts of acid-soluble Al or N is required. However, if these contents are excessive fine precipitation is difficult. It is preferable to maintain the content of acid-soluble Al to a range of about 0.01 to 0.15 % by weight and the content of N to a range of about 0.0030 to 0.020 % by weight.

Further, according to the present invention, the presence of Sb in the steel is indispensable, and it is possible to limit precipitation of C at grain boundaries or in crystal grains in the steel by providing a content of Sb. To enable such an effect, about 0.005 % or greater by weight of Sb is necessary. However, if the Sb content exceeds about 0.040% by weight, the problem of grain boundary embrittlement is encountered, and it is difficult to perform cold rolling. The Sb content is therefore maintained within a range of about 0.005 to 0.040% by weight.

To improve magnetic properties, other inhibitor strengthening components such as Cu, Cr, Bi, Sn, B, Ge and the like may be added as desired. The content of each of such components may be within well-known ranges. To prevent occurrence of surface defects due to hot-rolling embrittlement, it is preferable to add Mo in a range of about 0.005 to 0.020% by weight.

Next, a process of manufacture in accordance with the present invention will be described below.

Well-known manufacturing methods are applied for manufacturing the steel sheet, and ingots or slabs are reproduced as desired, adjusted to the desired size, and thereafter heated and hot-rolled. The hot-rolled steel sheet is processed by cold rolling one time or in a plurality of stages until its thickness is reduced to a desired final thickness.

For annealing before final cold rolling a high temperature in a range of about 850 to 1,200° C. is required to dissolve AlN, and, after this annealing, quenching to 500° C. or lower is required to precipitate AlN and it is also necessary to prevent precipitation of C at grain boundaries. If the cooling speed is lower than 15° C./s, C is precipitated at grain boundaries, or, if the cooling speed exceeds 500° C./s, the shape of the steel sheet after the cooling is deteriorated. The cooling rate is therefore maintained within a range of about 15 to 500° C./s.

Thereafter, a small strain ranging from about 0.005 to 3.0% is created in a temperature range from the temperature reached by quenching (about 500° C at the maximum) to about 200° C. The steel sheet is cooled during this straining or after a period of time of about 60 to 180 seconds in which the steel sheet is maintained at the same temperature range after the straining, or the steel sheet is cooled slowly at a cooling speed of about 2° C./s or lower.

This step is intended to precipitate sparsely arranged carbides having a size ranging from about 300 to 500 Å in grains, which effect relates to one of the most important features of the present invention. This processing is performed within a high temperature range from the temperature reached by cooling, i.e., about 500° C. at the maximum to about 200° C., and a strain is created in this temperature range, a feature unknown before the present invention. The precipitation of carbides is controlled to provide the desired size and density by balancing three influencing factors including (a) the fact that the C diffusion speed is comparatively high so that carbides are coarsely formed, (b) the fact that the carbide precipitation points are increased by straining so that carbides precipitate finely at a high density, and (c)the fact that precipitation of carbides at grain boundaries and in crystal grains is limited by the segregation effect of the presence of Sb.

Carbide precipitates have an excessively large size if the precipitation temperature exceeds about 500° C. They are excessively fine if the precipitation temperature is lower than about 200° C. Preferably the temperature at which precipitation is performed is within the range of about 450° C. to 300° C.

If the maintenance time is shorter than about 60 seconds, the carbides are not formed sufficiently coarsely. If it is longer than about 180 seconds, carbides are formed excessively coarsely, and the number of precipitation points is increased and the amount of solid solution is considerably reduced, with undesirable results.

When slow cooling is performed instead of the constant-temperature maintenance step it is necessary to set the cooling speed to about 2° C./s or lower.

It is necessary to effect straining immediately after quenching or in the temperature range of about 500 to 200° C. before the carbon precipitation processing. It is thereby possible to prevent carbides from precipitating excessively coarsely. If the amount of strain provided is less than about 0.005% by weight, the carbides are formed excessively coarsely. If the strain is more than about 3.0 %, carbides are finely precipitated at an excessively high density. The amount of strain is therefore set within a range of about 0.005 to 3.0%. A range of 0.01 to 1.0% is particularly preferable.

Needless to say, straining may be performed by any conventional straining method, e.g., a skin pass method based on rolling, a bending method using a bending roll, a straining method using a leveler roll, shot blasting, or the like.

The steel sheet is then subjected to final cold rolling. At this time, to obtain a high magnetic flux density, it is necessary to set the rolling reduction to a range of about 80 to 95%, as is well known.

Performing well-known aging or hot rolling treatment during this final cold rolling is further effective in the process of the present invention, because the amount of solid solution C in the steel of the present invention is large. The aging temperature is preferably adjusted to the range of about 200 to 400° C. If the aging temperature is higher than about 400° C. the shapes of precipitated carbides are changed so that the object of the present invention cannot be achieved. If the aging temperature is lower than about 200° C, solid solution C or solid solution N is not sufficiently fixed on dislocations, and further improvements in characteristics cannot be expected.

It is necessary to set the rolling reduction to a range of about 80 to 95%, as is well known. If the rolling reduction is less than about 80%, a sufficiently high magnetic flux density cannot be obtained. If the rolling reduction exceeds about 95%, it is difficult to develop secondary recrystallization grains.

The steel sheet after final cold rolling is degreased and is then annealed for decarburization and primary recrystallization. An annealing separation agent having MgO as a main component is thereafter applied to the steel sheet, and the steel sheet is coiled to be subjected to finishing annealing and is coated with an insulating material if necessary. Needless to say, the steel sheet may also be processed to fractionate magnetic domains by laser, plasma or any other means.

(Examples)

Example 1

Eleven steel ingots B, D, E, F, G, H, I, J, K, L, and M shown in Table 4 were provided in conformity with the present invention. These steels and other two steels A, C provided as comparative examples, thirteen steels in all were hot rolled in a conventional manner to form hot-rolled coils each having a thickness of 2.2 mm.

TABLE 4

| Ingot symbol | Composition (%) C | Si | Mn | P | Al | S | Se | Mo | Cu | Sb | Ge | Cr | Sn | Bi | B (ppm) | N (ppm) | Note |
|---|---|---|---|---|---|---|---|---|---|---|---|---|---|---|---|---|---|
| A | 0.074 | 3.25 | 0.075 | 0.004 | 0.019 | 0.018 | tr | tr | 0.02 | tr | tr | 0.01 | 0.02 | tr | 2 | 83 | Comparative example |
| B | 0.072 | 3.29 | 0.080 | 0.015 | 0.020 | 0.004 | tr | tr | 0.01 | 0.026 | tr | 0.01 | 0.02 | tr | 3 | 85 | Conformable example |
| C | 0.069 | 3.33 | 0.072 | 0.003 | 0.025 | 0.003 | 0.019 | tr | 0.03 | 0.003 | tr | 0.02 | 0.01 | tr | 3 | 83 | Comparative example |
| D | 0.071 | 3.28 | 0.075 | 0.004 | 0.024 | 0.002 | 0.020 | tr | 0.02 | 0.008 | tr | 0.01 | 0.02 | tr | 3 | 80 | Conformable example |
| E | 0.070 | 3.25 | 0.077 | 0.002 | 0.028 | 0.002 | 0.019 | tr | 0.02 | 0.015 | tr | 0.01 | 0.02 | tr | 2 | 75 | Conformable example |
| F | 0.073 | 3.30 | 0.074 | 0.003 | 0.022 | 0.003 | 0.018 | tr | 0.02 | 0.035 | tr | 0.01 | 0.01 | tr | 3 | 83 | Conformable example |
| G | 0.065 | 3.28 | 0.069 | 0.003 | 0.021 | 0.004 | 0.020 | 0.010 | 0.02 | 0.025 | tr | 0.01 | 0.02 | tr | 3 | 84 | Conformable example |
| H | 0.069 | 3.34 | 0.081 | 0.003 | 0.026 | 0.004 | tr | tr | 0.02 | 0.027 | tr | 0.07 | 0.01 | tr | 4 | 85 | Conformable example |
| I | 0.070 | 3.27 | 0.079 | 0.004 | 0.019 | 0.003 | 0.022 | tr | 0.08 | 0.030 | tr | 0.01 | 0.02 | tr | 3 | 86 | Conformable example |
| J | 0.072 | 3.33 | 0.068 | 0.003 | 0.025 | 0.002 | 0.020 | tr | 0.02 | 0.023 | 0.015 | 0.02 | 0.02 | tr | 2 | 79 | Conformable example |
| K | 0.068 | 3.27 | 0.072 | 0.004 | 0.027 | 0.003 | 0.019 | tr | 0.01 | 0.027 | tr | 0.01 | 0.12 | tr | 3 | 83 | Conformable example |
| L | 0.073 | 3.28 | 0.073 | 0.003 | 0.028 | 0.004 | 0.023 | tr | 0.01 | 0.024 | tr | 0.01 | 0.02 | 0.006 | 3 | 80 | Conformable example |
| M | 0.079 | 3.31 | 0.075 | 0.004 | 0.025 | 0.002 | 0.018 | tr | 0.02 | 0.029 | tr | 0.01 | 0.02 | tr | 21 | 84 | Conformable example |

Each steel sheet was thereafter subjected to normal annealing at 1,000° C. for 90 seconds and was cold-rolled until its thickness was reduced to an intermediate thickness of 1.50 mm. The reduced steel sheet was further annealed at 1,100° C. for 90 seconds, quenched at a rate of 60° C./s to 350° C., and passed through a slow cooling box having a bending roll and was thereby strained to an extent of 1.5 % while being cooled at a rate of 2° C./s to 200° C. The steel sheet was thereafter cooled in atmospheric air.

The steel sheet was then rolled until its thickness was reduced to a final thickness of 0.22 mm, electrolytically degreased, and subjected to decarburization/primary recrystallization annealing at 850° C. for 2 minutes in a wet hydrogen atmosphere. An MgO agent containing 5% $TiO_2$ was then applied to the steel sheet, and the steel sheet was subjected to finishing annealing at 1,200° C. for 10 hours. Thereafter, the surfaces of the sheet were coated to give the steel sheet tensile stress and were partially processed to fractionate magnetic domains at 10 mm pitches by the plasma jet method. Table 5 shows the magnetic characteristics before and after the magnetic domain fractionating processing of the steel sheets.

TABLE 5

| Ingot symbol | Magnetic domain fractionating processing* | Magnetic flux density $B_8$ (T) | Core loss $W_{17/50}$ (W/kg) | Note |
|---|---|---|---|---|
| A | Unprocessed | 1.875 | 1.15 | Comparative |
| | Processed | 1.874 | 1.09 | example |
| B | Unprocessed | 1.935 | 0.92 | Conformable |
| | Processed | 1.936 | 0.78 | example |
| C | Unprocessed | 1.883 | 1.07 | Comparative |
| | Processed | 1.883 | 1.02 | example |
| D | Unprocessed | 1.938 | 0.95 | Conformable |
| | Processed | 1.938 | 0.84 | example |
| E | Unprocessed | 1.941 | 0.87 | Conformable |
| | Processed | 1.942 | 0.73 | example |
| F | Unprocessed | 1.946 | 0.85 | Conformable |
| | Processed | 1.945 | 0.70 | example |
| G | Unprocessed | 1.942 | 0.86 | Conformable |
| | Processed | 1.943 | 0.72 | example |
| H | Unprocessed | 1.937 | 0.97 | Conformable |
| | Processed | 1.938 | 0.83 | example |
| I | Unprocessed | 1.940 | 0.87 | Conformable |
| | Processed | 1.941 | 0.72 | example |
| J | Unprocessed | 1.941 | 0.83 | Conformable |
| | Processed | 1.941 | 0.70 | example |
| K | Unprocessed | 1.938 | 0.86 | Conformable |
| | Processed | 1.937 | 0.73 | example |
| L | Unprocessed | 1.942 | 0.85 | Conformable |
| | Processed | 1.943 | 0.71 | example |
| M | Unprocessed | 1.939 | 0.88 | Conformable |

TABLE 5-continued

| Ingot symbol | Magnetic domain fractionating processing* | Magnetic flux density $B_8$ (T) | Core loss $W_{17/50}$ (W/kg) | Note |
|---|---|---|---|---|
| | Processed | 1.938 | 0.75 | example |

Note:
*Magnetic domain fractionating at 10 mm pitches by plasma jet method

As appears in Table 5, the conformable examples (all except A and C) have characteristics improved in magnetic flux density and core loss due to this invention, in comparison with those of the comparative Examples A and C. The magnetic flux density of the conformable examples was 1.946 T (Ingot F) at the maximum with respect to B:, as compared to 1 875 and 1.883 for comparative Examples A and C. The magnetic domain fractionating processing remarkably improved the core loss but did not substantially adversely influence the magnetic flux density.

Example 2

The steel ingot F shown in Table 4 was hot-rolled in a conventional manner to provide hot-rolled steel sheets having thicknesses of 2.4, 2.2, 2.0, and 1.5 mm.

The hot-rolled steel sheets having thicknesses of 2.4 and 2.2 mm were respectively annealed at 1,175° C. for 90 seconds and at 1,150° C. for 90 seconds, then quenched to 400° C. at an average cooling speed of 50° C./s, strained to an extent of 2% by a hot skin pass roller, slowly cooled to 250° C. at an average cooling speed of 1.5° C./s, and quenched in water. Thereafter, these steel sheets were respectively cold-rolled to final thicknesses of 0.30 and 0.28 mm. When the thicknesses of these steel sheets were respectively reduced to 1.3 and 1.0 mm, each sheet was separated into two. One of them was successively cold-rolled and the other was aged at 300° C. for 2 minutes and cold-rolled to the final thickness.

The hot-rolled steel sheets having thicknesses of 2.0 and 1.5 mm were normalized at 1,000° C. for 90 seconds, naturally cooled, respectively cold-rolled to thicknesses of 1.4 and 1.1 mm, annealed at 1,100° C. for 90 seconds, and quenched to 350° C. at an average speed of 60° C/s. They were then strained to an extent of 1.0 % by a hot leveler, maintained at 320° C for 120 seconds, and taken out of the furnace and naturally cooled. Thereafter they were respectively cold-rolled to final thicknesses of 0.20 and 0.15 mm. When the thicknesses of these steel sheets were respectively reduced to 0.7 and 0.55 mm, each sheet was separated into two. One of them was successively cold-rolled and the other was aged at 300° C. for 2 minutes and cold-rolled to the final thickness. After final cold rolling the steel sheets were degreased and subjected to decarburization/primary recrystallization annealing at 850° C. for 2 minutes in a wet hydrogen atmosphere. An MgO containing 2 % $SrSO_4$ was then applied to the steel sheets and the steel sheets were subjected to finishing annealing at 1,200° C for 10 hours. Thereafter the surfaces of the sheets were coated to give a tensile stress to the sheets and processed to fractionate magnetic domains by 5 mm pitch electron beam irradiation. Table 6 shows the magnetic characteristics of the steel sheets thus processed.

TABLE 6

| Final thickness (mm) | Item: Non-aged $B_8$ (T) | Non-aged $W_{17/50}$ (W/Kg) | Aged* $B_8$ (T) | Aged* $W_{17/50}$ (W/Kg) |
|---|---|---|---|---|
| 0.30 | 1.942 | 0.97 | 1.945 | 0.90 |
| 0.28 | 1.948 | 0.93 | 1.944 | 0.88 |
| 0.20 | 1.940 | 0.87 | 1.942 | 0.82 |
| 0.15 | 1.934 | 0.86 | 1.930 | 0.77 |

Note:
*Aged at 300° C. for 2 minutes during cold rolling

As appears in Table 6 the magnetic flux density was improved even though the final thickness was substantially reduced down to 0.15 mm, and the magnetic domain fractionating processing during the cold rolling remarkably improved the core loss but did not substantially influence the magnetic flux density. Example 3

The ingot G shown in Table 4 was hot-rolled in a conventional manner to provide a hot-rolled coil having a thickness of 2.0 mm. This steel sheet was normalized at 1,000° C. for 90 seconds and was cold-rolled to an intermediate thickness of 1.50 mm. This steel sheet was separated into three pieces and all were subjected to intermediate annealing at 1,100° C. for 90 seconds. This cooling was performed under three different sets of conditions.

The first set of conditions (I) was that the steel sheet was cooled in hot water at 80° C.

The second set of conditions (II) was that the steel sheet was cooled to 350° C. at an average cooling speed of 60° C./s, was slowly cooled to 300° C. for 2 minutes while being strained to an extent of 0.5% by a bending roll, and was cooled in atmospheric air.

The third set of conditions (III) was that the steel sheet was cooled to 400° C. at an average cooling speed of 60° C./s, was cooled to 250° C. at a cooling speed of 2° C./s, and was cooled in atmospheric air.

Each of these three steel sheets was separated into two. One of them was cold-rolled in a conventional manner to a final thickness of 0.20 mm, while the other was hot-rolled at 250° C. to a final thickness of 0.20 mm. After final cold rolling, all the steel sheets were degreased and subjected to decarburization/primary recrystallization annealing at 860° C. for 2 minutes in a wet hydrogen atmosphere. An MgO separator containing 10 % $TiO_2$ was then applied to the steel sheets, and the steel sheets were subjected to finishing annealing at 1,200° C. for 10 hours. Thereafter the surfaces of the sheets were tension-coated and the magnetic characteristics were measured. Table 7 shows the results of this measurement.

TABLE 7

| Cooling condition | Item: Normally rolled sheet $B_8$ (T) | Normally rolled sheet $W_{17/50}$ (W/Kg) | Warm-rolled sheet* $B_8$ (T) | Warm-rolled sheet* $W_{17/50}$ (W/Kg) | Note |
|---|---|---|---|---|---|
| (I) | 1.882 | 1.08 | 1.888 | 0.97 | Comparative example |
| (II) | 1.939 | 0.85 | 1.941 | 0.82 | Conformable example |
| (III) | 1.896 | 1.05 | 1.894 | 1.95 | Comparative example |

Note:
*Finishing-cold-rolled at 250° C.

As shown in Table 7, the conformable example processed under the cooling conditions (II) was improved in both magnetic flux density and core loss in comparison with the comparative examples processed under the cooling conditions (I) and (III), and it was found that the creation of a small strain in a temperature range of 500 to 200° C. during the cooling for the annealing before the final cold rolling was effective in improving the magnetic characteristics of the sheet.

According to the present invention, a silicon steel sheet containing Al and Sb is used and cooling control and creation of a small strain are effected during cooling for annealing before final cold rolling, so that an oriented silicon steel sheet having a high magnetic flux density can be manufactured with stability even if the sheet thickness is reduced. The oriented silicon steel sheet manufactured in accordance with the present invention has excellent properties for use in transformer cores and other products having high magnetic flux density and good stability with reduced core loss.

What is claimed is:

1. A method of manufacturing an oriented silicon steel sheet having improved magnetic characteristics in which a hot-rolled steel sheet of a silicon steel having a composition containing about 0.01 to 0.15% by weight of acid-soluble Al and about 0.005 to 0.04% by weight of Sb is processed by cold-rolling until its thickness is reduced to a desired final thickness comprising the steps of:

softening-annealing said steel sheet before final cold rolling;

successively quenching said steel sheet at a cooling speed of about 15 to 500° C./s to a temperature of about 500° C. or lower;

applying to said steel sheet a strain ranging from about 0.005 to 3.0% while maintaining said sheet at a temperature in the range from about the temperature reached by quenching to about 200° C.;

controlling carbide precipitation at an effective cooling speed of about 2° C./S for lower to precipitate sparsely arranged carbides ranging in size from about 300 to 500Å in grains in said steel sheet by cooling said steel sheet during said straining or after a period of time of about 60 to 180 seconds in which said steel sheet is maintained in essentially the same temperature range after said straining;

thereafter performing final cold rolling with a rolling reduction of about 80 to 95%; and annealing said steel sheet for primary recrystallization and for decarburization, applying an annealing separation agent and effecting secondary-recrystallization annealing and purification-annealing.

2. A method of manufacturing an oriented silicon steel sheet having improved magnetic characteristics according to claim 1, wherein the final sheet thickness is about 0.15 to 0.25 mm.

3. A method of manufacturing an oriented silicon steel sheet having improved magnetic characteristics according to claim 1, wherein the temperature of said steel sheet during said final cold rolling is within the range of about 200 to 400° C.

4. A method of manufacturing an oriented silicon steel sheet having improved magnetic characteristics according to claim 1, wherein said step of final cold rolling includes the further step of aging said steel sheet at a temperature in the range of about 200 to 400° C.

5. A method of manufacturing an oriented silicon steel sheet having improved magnetic characteristics according to claim 1, wherein said step of creating said strain is performed by applying a tension in the longitudinal direction of the steel sheet.

6. A method of manufacturing an oriented silicon steel sheet having improved magnetic characteristics according to claim 1, wherein said step of creating said strain is performed by applying bending to said steel sheet using a roll.

7. A method of manufacturing an oriented silicon steel sheet having improved magnetic characteristics according to claim 1, wherein said step of creating said strain is performed by applying shot blast.

* * * * *

UNITED STATES PATENT AND TRADEMARK OFFICE

CERTIFICATE OF CORRECTION

PATENT NO. : 5,244,511

DATED : September 14, 1993

INVENTOR(S) : Michiro Komatsubara; Mitsumasa Kurosawa; Yasuyuki Hayakawa; Takahiro Kan; Toshio Sadayori It is certified that error appears in the above-indentified patent and that said Letters Patent is hereby corrected as shown below:

Column 2, line 68, please change "B" to --$B_{10}$--.

Column 7, line 45, please change "110grains" to --<110> grains--.

Column 13, line 16, please change "1 875" to --1.875--.

Column 14, line 17, "Example 3" should be a heading beginning at line 18.

Column 15, line 38, please change "for" to --or--.

Signed and Sealed this

Nineteenth Day of April, 1994

Bruce Lehman

*Attest:*

BRUCE LEHMAN

*Attesting Officer*

*Commissioner of Patents and Trademarks*